US007021086B2

(12) United States Patent
Ory et al.

(10) Patent No.: US 7,021,086 B2
(45) Date of Patent: Apr. 4, 2006

(54) THREE-DIMENSIONAL FILET STITCH FABRIC WALL REINFORCEMENT

(75) Inventors: Francois Regis Ory, Fontaines Saint Martin (FR); Michel Therin, Lyons (FR); Alfredo Meneghin, Anse (FR)

(73) Assignee: Sofradim Production, Trevoux (FR)

( * ) Notice: Subject to any disclaimer, the term of this patent is extended or adjusted under 35 U.S.C. 154(b) by 88 days.

(21) Appl. No.: 10/488,203

(22) PCT Filed: Oct. 4, 2002

(86) PCT No.: PCT/FR02/03397

§ 371 (c)(1),
(2), (4) Date: Mar. 16, 2004

(87) PCT Pub. No.: WO03/031709

PCT Pub. Date: Apr. 17, 2003

(65) Prior Publication Data

US 2005/0252569 A1 Nov. 17, 2005

(30) Foreign Application Priority Data

Oct. 5, 2001 (FR) ..... 01 12998

(51) Int. Cl.
*D04B 21/10* (2006.01)

(52) U.S. Cl. ..... 66/195

(58) Field of Classification Search ..... 66/195, 66/192, 193

See application file for complete search history.

(56) References Cited

U.S. PATENT DOCUMENTS

| | | | | |
|---|---|---|---|---|
| 3,118,294 | A * | 1/1964 | Laethem | 66/193 |
| 3,124,136 | A * | 3/1964 | Usher | 606/213 |
| 5,771,716 | A * | 6/1998 | Schlussel | 66/195 |
| 6,408,656 | B1 * | 6/2002 | Ory et al. | 66/195 |
| 6,477,865 | B1 * | 11/2002 | Matsumoto | 66/195 |
| 6,630,414 | B1 * | 10/2003 | Matsumoto | 442/1 |

FOREIGN PATENT DOCUMENTS

| | | | |
|---|---|---|---|
| EP | 1055757 | A1 * | 11/2000 |
| FR | 2779937 | A1 * | 12/1999 |
| WO | WO 9814134 | A1 * | 4/1998 |
| WO | WO 9849967 | A1 * | 11/1998 |
| WO | WO 0115625 | A * | 3/2001 |

* cited by examiner

*Primary Examiner*—Danny Worrell
(74) *Attorney, Agent, or Firm*—Oliff & Berridge, PLC

(57) ABSTRACT

The invention concerns a fabric made with biocompatible material filaments, shaped like an open-mesh unblocked weave forming, in the laps constituting, respectively the front (AV) and rear (AR) walls of the fabric, substantially polygonal cells providing the fabric at least in two perpendicular directions with substantially balanced dynamometric behavior, said laps in the front and rear walls being linked by a bracing. The invention is characterized in that the bracing is provided by monofilaments of one of the laps forming one of the walls (AV and AR) of the reinforcement, each of said monofilaments forming, after a constant number of rows of meshes in its lap, a mesh (M) with one of the meshes (m3) of one of the laps of the other wall (AR and AV) of the fabric.

4 Claims, 2 Drawing Sheets

THREE-DIMENSIONAL FILET STITCH FABRIC WALL REINFORCEMENT

Figure 1:
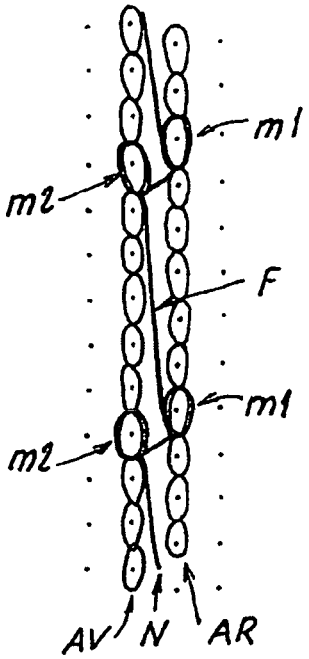

The invention relates to a three-dimensional open-worked fabric wall reinforcement useful, for example, in parietal and/or visceral surgery, but capable of being applied to other fields of surgery.

French patent application FR-A-2 779 937 already discloses an open-worked fabric formed by monofilaments consisting of a biocompatible polymer material, such as polyester, polyamide or polypropylene, which are worked in a weave with open unblocked meshes which, in the laps forming respectively the front and rear walls of the fabric, form a plurality of cells of substantially polygonal shape. These cells give the fabric a balanced dynamometric behavior, that is to say offering substantially the same resistances to elongation and the same possibilities of elastic return at least in the two main directions, to be precise longitudinally and transversely.

In practice, the lap or laps forming the front wall of the fabric is or are connected to the lap or laps forming the rear wall by means of a bracing composed of one or more laps, of which the meshes engaged with the meshes of the front and rear walls are connected by means of long floats.

It becomes clear that, in this type of fabric, the floats of the bracing reduce the elasticity and resistance characteristics differently in the two main directions and therefore adversely affect the desired isoelasticity.

Moreover, the presence of this or these connecting laps increases the mass per unit area of the fabric and, if they are produced by monofilaments, tends to reduce the conformability and flexibility of the fabric, whereas, on the contrary, parietal repair surgery requires flexible and porous fabrics with a low mass per unit area.

The object of the present invention is to provide a wall reinforcement which overcomes these disadvantages and the fabric of which has the same resistance and elasticity characteristics longitudinally and transversely, while at the same time improving its flexibility and conformability, without affecting its low density and high porosity.

For this purpose, in the wall reinforcement according to the invention, the bracing of the laps forming respectively the front wall and the rear wall of the fabric is ensured by means of the monofilaments of one of the laps composing one of the walls of the reinforcement, each of these monofilaments forming, after a constant number of rows of meshes in its lap, a mesh with one of the meshes of one of the laps of the other wall of the fabric.

Thus, for example, one of the two laps composing the front wall comprises, at regular intervals, meshes engaging with the meshes of one of the laps of the rear wall, in order to ensure the connection and hold of the two walls.

By means of this arrangement, not only is there no additional lap between the laps forming the front and rear walls, but there are also no longer any floats between these two laps, such floats possessing a more limited elongation capacity than the meshed structure obtained.

Moreover, each monofilament portion extending between the mesh formed in the front wall and the mesh formed in the rear wall ensures an excellent stability of these two walls by virtue of its stiffness or rigidity and thus makes it possible to limit the number of meshes forming a brace, while at the same time avoiding influencing the dynamic characteristics of the reinforcement obtained.

The invention will be understood more clearly from the following description, with reference to the accompanying diagrammatic drawing illustrating an embodiment of a knitted wall reinforcement according to the invention.

Figure 2:
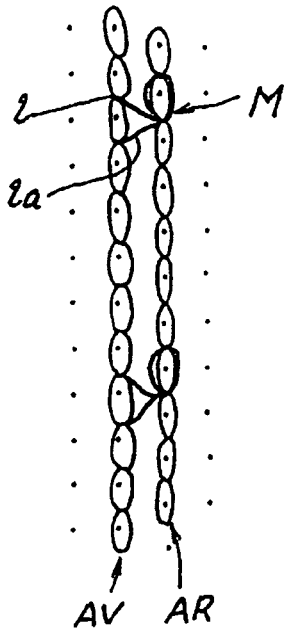
Figure 3A:
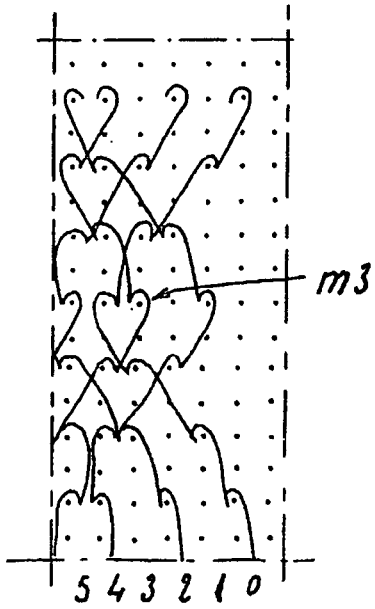
Figure 3B:
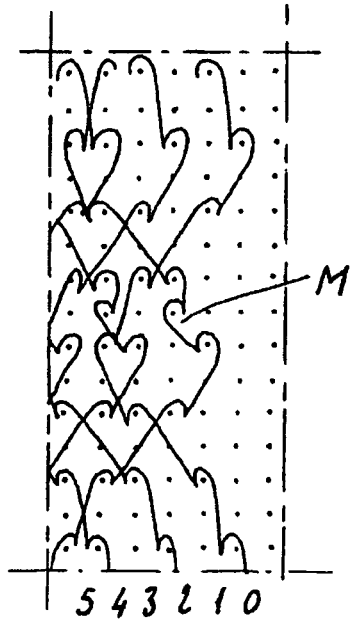
Figure 4:
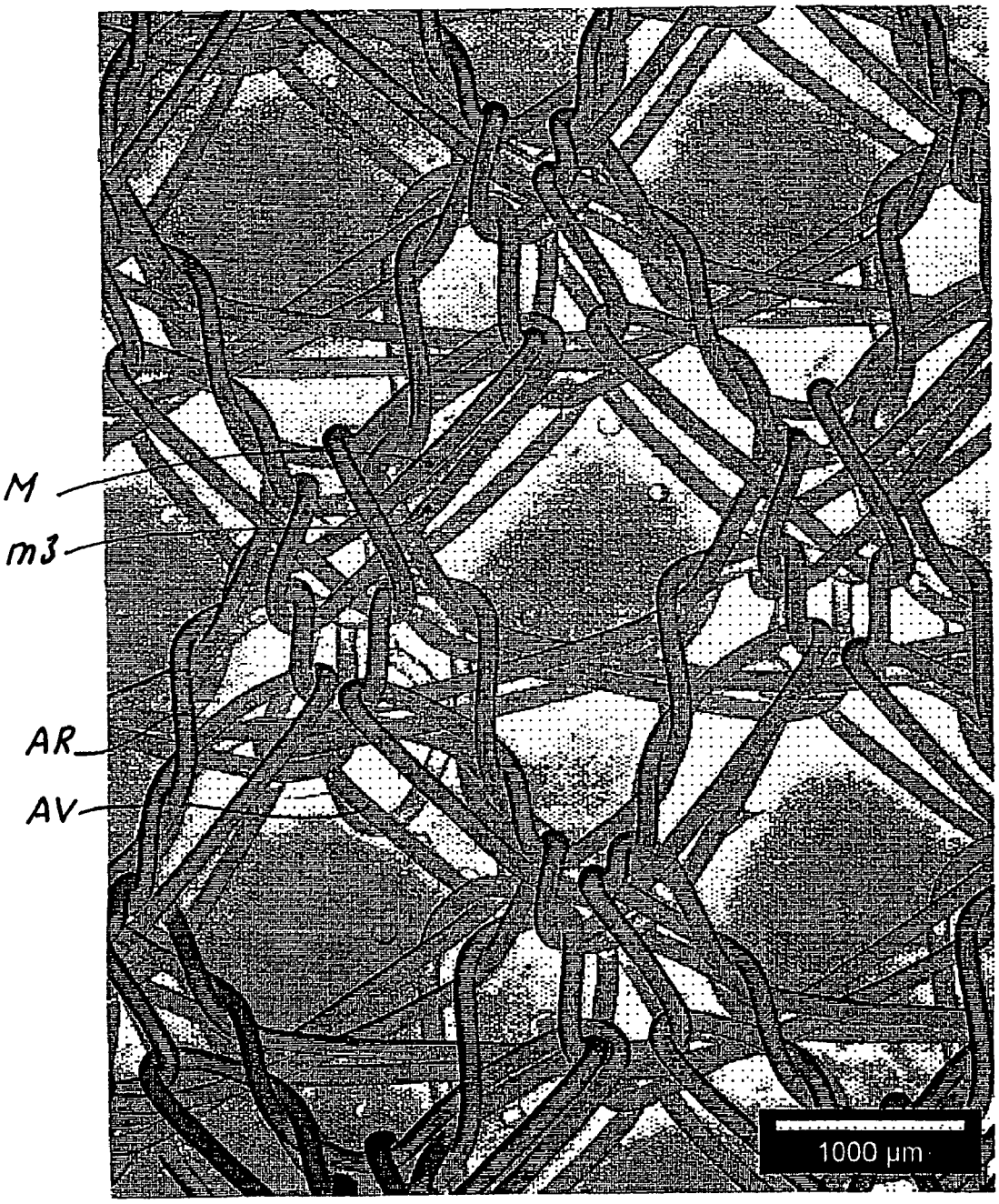

FIG. 1 is a partial cross-sectional side view illustrating a fabric with bracing by means of an intermediate lap, FIG. 2 is a cross-sectional side view of the fabric according to the invention, FIGS. 3*a* and 3*b* illustrate, for an embodiment of the fabric according to the invention, a diagram of the connection of the two laps forming respectively the rear wall and the front wall, FIG. 4 is a front image of a fabric according to the invention, taken by means of scanning electron microscopy with a magnification of 20.

In FIGS. 1 and 2, the mesh columns AV and AR each indicate diagrammatically the two laps of meshes formed on a double-section Rachel loom by means of monofilaments of a biocompatible material and, for example, polypropylene monofilaments.

In FIG. 1, the connection between the front and rear walls is ensured by means of an intermediate lap N alternately forming, every six rows, one mesh ml on one of the laps of the rear wall of the fabric, then one mesh m2 on one of the laps of the front wall, before a float F is formed on the following six meshes, until the next mesh ml is produced.

Of course, this connection is made in various columns of the fabric, and, for example, every two columns, with an offset of the rows in which the loops m1, m2 are formed.

This FIG. 1 illustrates the current structure of knitted reinforcements and makes it clear that, during the stretching of the laps, the long floats F have little possibility of following the elongation movement, at all events less than a mesh, the loop of which can close on itself to produce thread, and therefore contribute to alerting the dynamometric characteristics of the reinforcement.

FIG. 2, which corresponds to the fabric according to the invention, shows that the connection of the front AV and rear AR walls is ensured, for example every two columns and every six rows, by one of the monofilaments 2 forming one of the laps of one of the walls and, for example, of the front wall AV, this monofilament forming a mesh M on a mesh of one of the two laps composing the rear wall AR. As a result of this, and with the exception of the portions 2*a* of monofilament 2 extending between the two walls of the fabric, there is no other element, such as a float, between these two walls.

As a consequence, in the event of stretching and even of elastic return, the meshed structures of each of the two walls AV and AR are not impeded by float threads, and the connecting portions 2*a*, arranged transversely, are more capable of following the movements, at the same time tolerating the tightening or loosening of the meshes which they connect between the two walls.

FIGS. 3*a* and 3*b* illustrate the connection screens of the two laps forming respectively the rear wall and the front wall of a fabric according to the invention, produced according to the following scale.

Front wall:
lap a) 0.1.1.1/1.2.2.2/3.4.4.4/5.4.4.4/4.3.3.3/2.1.1.1//
lap b) 5.4.4.4/4.3.3.3/2.1.1.1/0.1.2.1/1.2.2.2/3.4.4.4//

Rear wall:
lap c) 4.4.5.4/4.4.4.3/3.3.2.1/1.1.0.1/1.1.1.2/2.2.3.4//
lap d) 1.1.0.1/1.1.1.2/2.2.3.4/4.4.5.4/4.4.4.3/3.3.2.1//

This fabric is produced with polypropylene monofilaments having a dimension of between 0.07 and 0.14 millimeters, preferably 0.08 or 0.10 millimeters, said dimension combining fineness, strength and stiffness perfectly. The filaments are worked in a weave of the Atlas type, forming locally a mesh M on some needles of the rear structure, simultaneously with the formation on these needles of meshes m3 forming one of the two laps of the rear wall.

This weave makes it possible to produce the fabric appearing on the magnification of FIG. 4, where M represents the mesh coming from a front lap AV and forming a double mesh with a mesh m3 of one of the laps of the rear wall AR arranged at the forefront.

This image clearly shows that, by means of the cells of general polygonal shape defined by the meshes of the various laps, the fabric has an open-worked structure possessing high porosity along with low density. It also shows that, by virtue of their distribution on the sides of the polygons, the open unblocked meshes give the fabric substantially the same possibilities of deformation longitudinally and transversely, corresponding, in FIG. 4, to the vertical and transverse directions respectively.

What is claimed is:

1. A three-dimensional open-worked fabric wall reinforcement produced with monofilaments consisting of a biocompatible material, worked in a weave with open unblocked meshes that form, in laps respectively forming the front and rear walls of the fabric, cells of substantially polygonal shape giving the fabric substantially balanced dynamometric behaviors at least in two perpendicular directions, said laps of the front and rear walls being connected by a bracing, wherein the bracing is ensured by the monofilaments of one of the laps composing one of the walls of the reinforcement, each of the monofilaments forming, after a constant number of rows of meshes in its lap, a mesh with one of the meshes of one of the laps of the other wall of the fabric.

2. The wall reinforcement as claimed in claim 1, wherein its respectively front and rear walls are each formed by two laps of monofilaments knitted according to the following scale;

Front wall:

lap a) 0.1.1.1/1.2.2.2/3.4.4.4/5.4.4.4/4.3.3.3/2.1.1.1// lap b) 5.4.4.4/4.3.3.3.2.1.1.1/0.1.2.1/1.2.2.2/3.4.4.4//

Rear wall:

lap c) 4.4.5.4/4.4.4.3/3.3.2.1/1.1.0.1/1.1.1.2/2.2.3.4// lap d) 1.1.0.1/1.1.1.2/2.2.3.4/4.4.5.4/4.4.4.3/3.3.2.1//.

3. The wall reinforcement as claimed in claim 2, wherein the monofilaments used consist of polypropylene and have a dimension of between 0.07 and 0.14 millimeters.

4. The wall reinforcement as claimed in claim 2, wherein the monofilaments used consist of polypropylene and have a dimension of 0.10 millimeters.

* * * * *